US006123127A

United States Patent [19]

Su

[11] Patent Number: 6,123,127

[45] Date of Patent: Sep. 26, 2000

[54] BAG HAVING CELLULAR PHONE RECEIVING STRUCTURE

[76] Inventor: Ken Jui Su, No. 180, Shu Wang 1st Road, Ta Li City, Taichung Hsien, Taiwan

[21] Appl. No.: 09/285,910

[22] Filed: Apr. 2, 1999

[51] Int. Cl.[7] ..... A45C 1/02; A45C 3/02

[52] U.S. Cl. ..... 150/116; 150/117; 190/111

[58] Field of Search ..... 150/112, 116, 150/117; 190/109, 111; 206/320

[56] References Cited

U.S. PATENT DOCUMENTS

| | | | |
|---|---|---|---|
| 1,793,899 | 2/1931 | Benforado | 150/117 X |
| 1,927,624 | 9/1933 | Appel | 150/116 X |
| 2,988,125 | 6/1961 | Reynolds | 150/116 X |
| 3,147,788 | 9/1964 | Pinnola | 150/117 X |
| 4,840,258 | 6/1989 | Tomikawa et al. | 190/111 X |

FOREIGN PATENT DOCUMENTS

| | | | |
|---|---|---|---|
| 2178401 | 2/1987 | United Kingdom | 190/111 |

*Primary Examiner*—Jes F. Pascua
*Attorney, Agent, or Firm*—Charles E. Baxley, Esq.

[57] ABSTRACT

A bag includes a casing pivotally secured to one side portion for allowing the cellular phone to be engaged into and removed from the casing without opening the bag. A housing is secured in the bag, and a casing includes a bottom portion pivotally coupled to the housing at a hinge line. The upper portion of the casing is detachahly secured to the bag for opening the casing. One or more fasteners are secured to the bag, and the casing includes one or more curved slots for slidably receiving the fasteners and for pivotally coupling the casing to the bag.

5 Claims, 7 Drawing Sheets

BAG HAVING CELLULAR PHONE RECEIVING STRUCTURE

BACKGROUND OF THE INVENTION

1. Field of the Invention

The present invention relates to a bag, and more particularly to a bag having a structure for receiving the cellular phones or the portable phones.

2. Description of the Prior Art

Typical bags are provided for receiving the documents and the other objects, such as the cellular phones or the portable phones. However, once the cellular phones are received in the bags, the documents will be damaged by the cellular phones.

The present invention has arisen to mitigate and/or obviate the afore-described disadvantages of the conventional bags.

SUMMARY OF THE INVENTION

The primary objective of the present invention is to provide a bag having a structure for receiving the cellular phones or the portable phones.

In accordance with one aspect of the invention, there is provided a bag comprising a bag body including a chamber formed therein, and a casing pivotally secured to the bag body and receivable in the chamber of the bag body for receiving an object and for allowing the cellular phone to be engaged into and removed from the casing when the casing is opened relative to the bag body.

The bag body includes a side portion having the chamber formed therein, the casing includes a bottom portion pivotally coupled to the bag body and includes an upper portion, and means, for detachably securing the upper portion of the casing to the bag body.

A housing is secured in the chamber of the bag body, the casing includes a bottom portion pivotally coupled to the housing at a hinge line and includes an upper portion, and a securing device is provided for detachably securing the upper portion of the casing to the bag body. The housing includes two plates and a partition secured between the plates and located in the bag body, the partition includes an orifice formed therein.

The bag body includes at least one fastener secured thereto, the casing includes a bottom portion having at least one curved slot formed therein for slidably receiving the at least one fastener of the bag body and for pivotally coupling the bottom portion of the casing to the bag body. The casing includes a bottom portion having a box provided therein for receiving the object.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
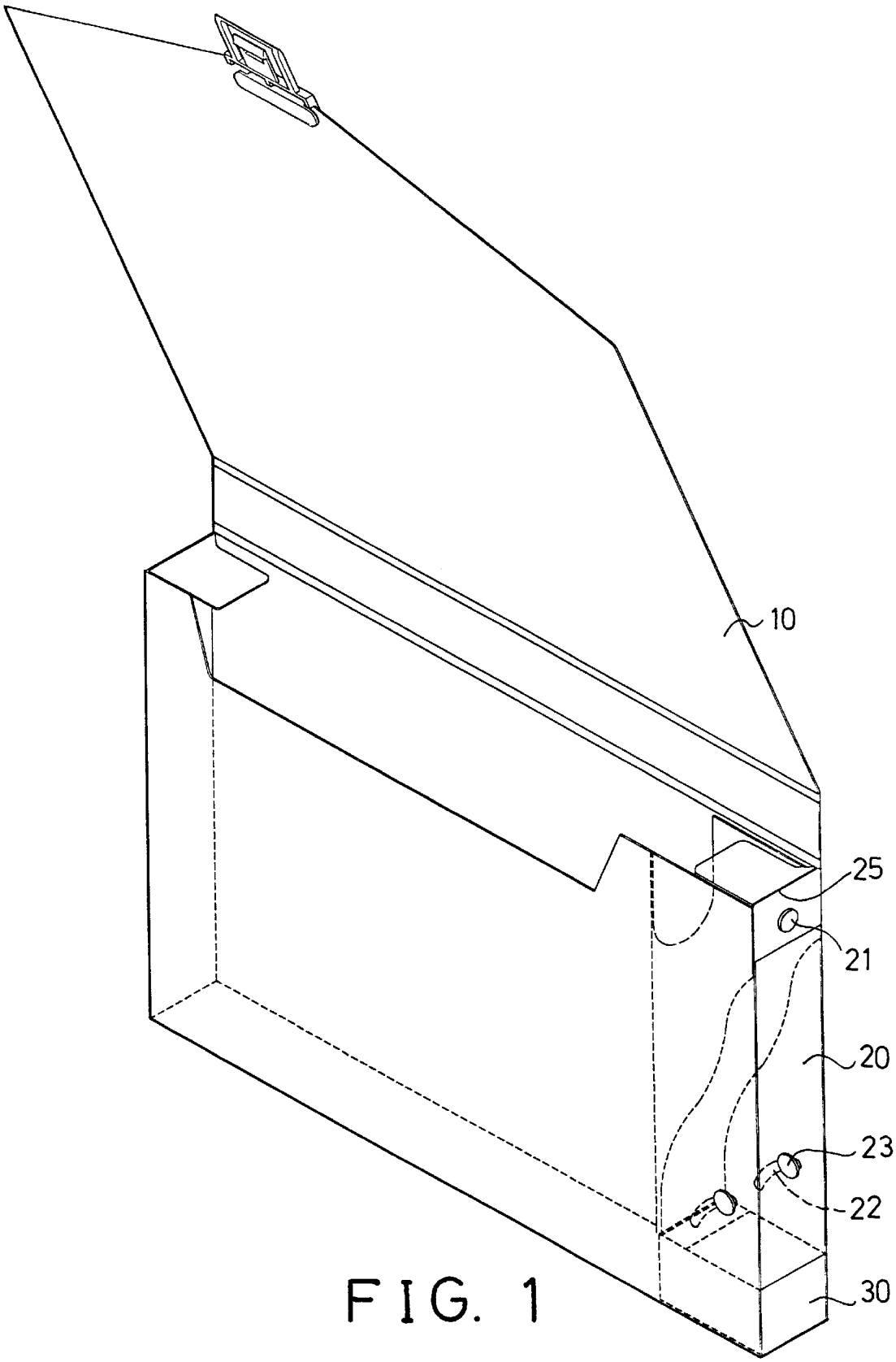
FIG. 1 is a perspective view of a bag in accordance with the present invention.
Figure 2:
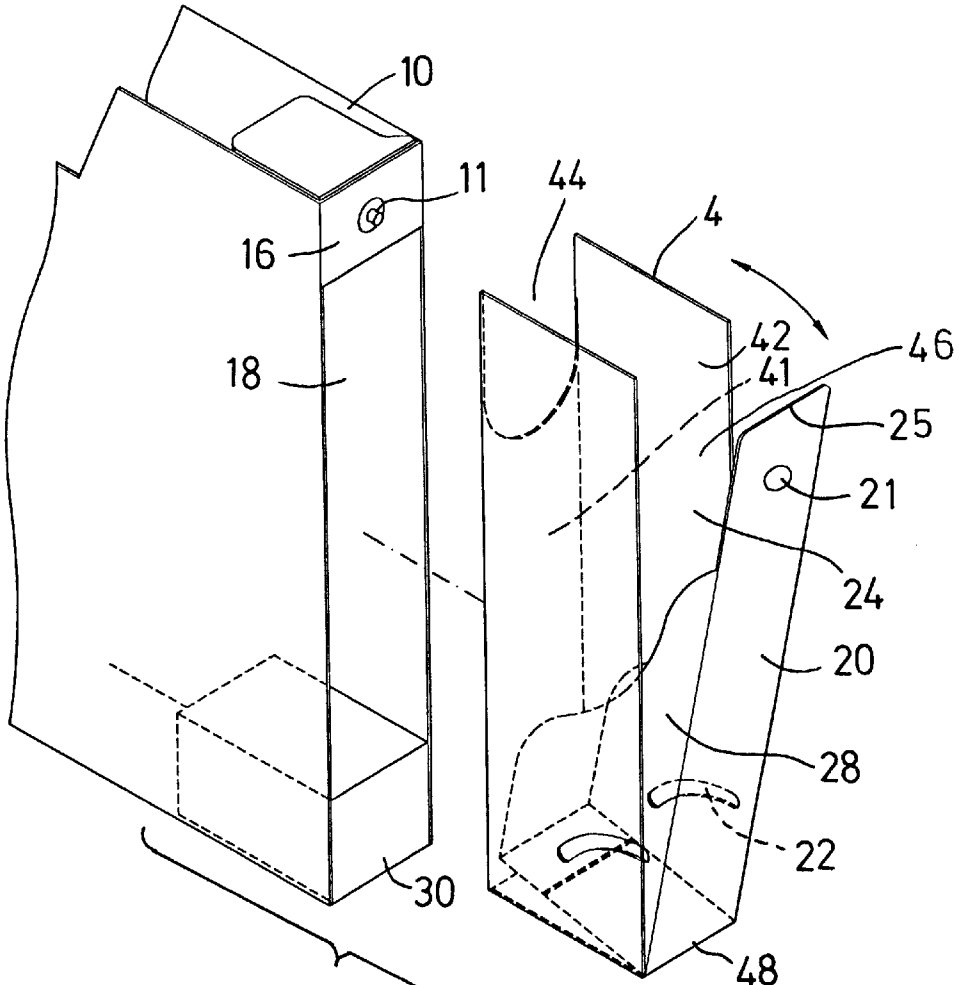
FIG. 2 is a partial exploded view of the bag.
Figure 4:
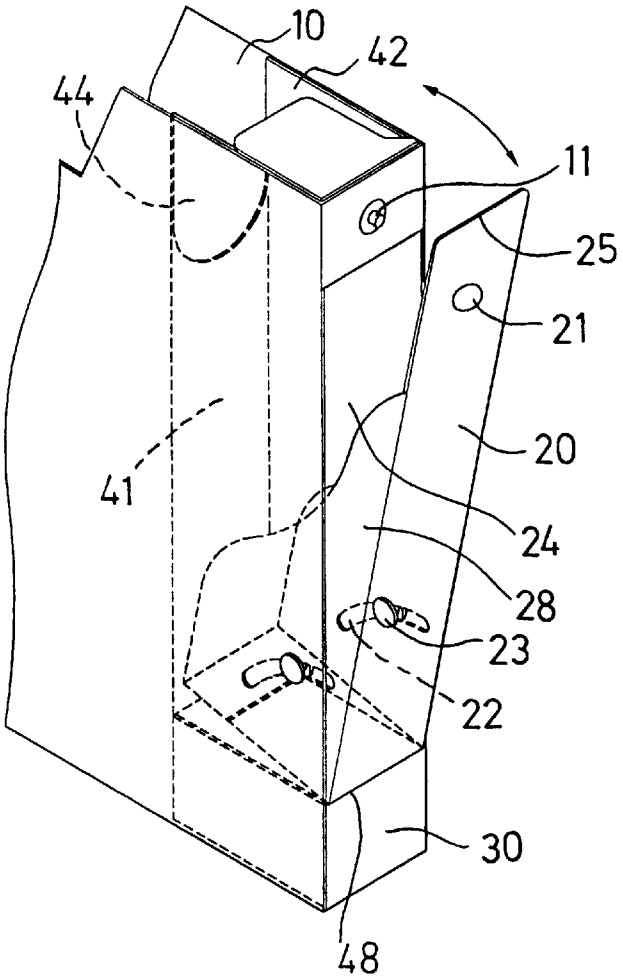
FIG. 4 is a partial perspective view of the bag.
Figure 3:
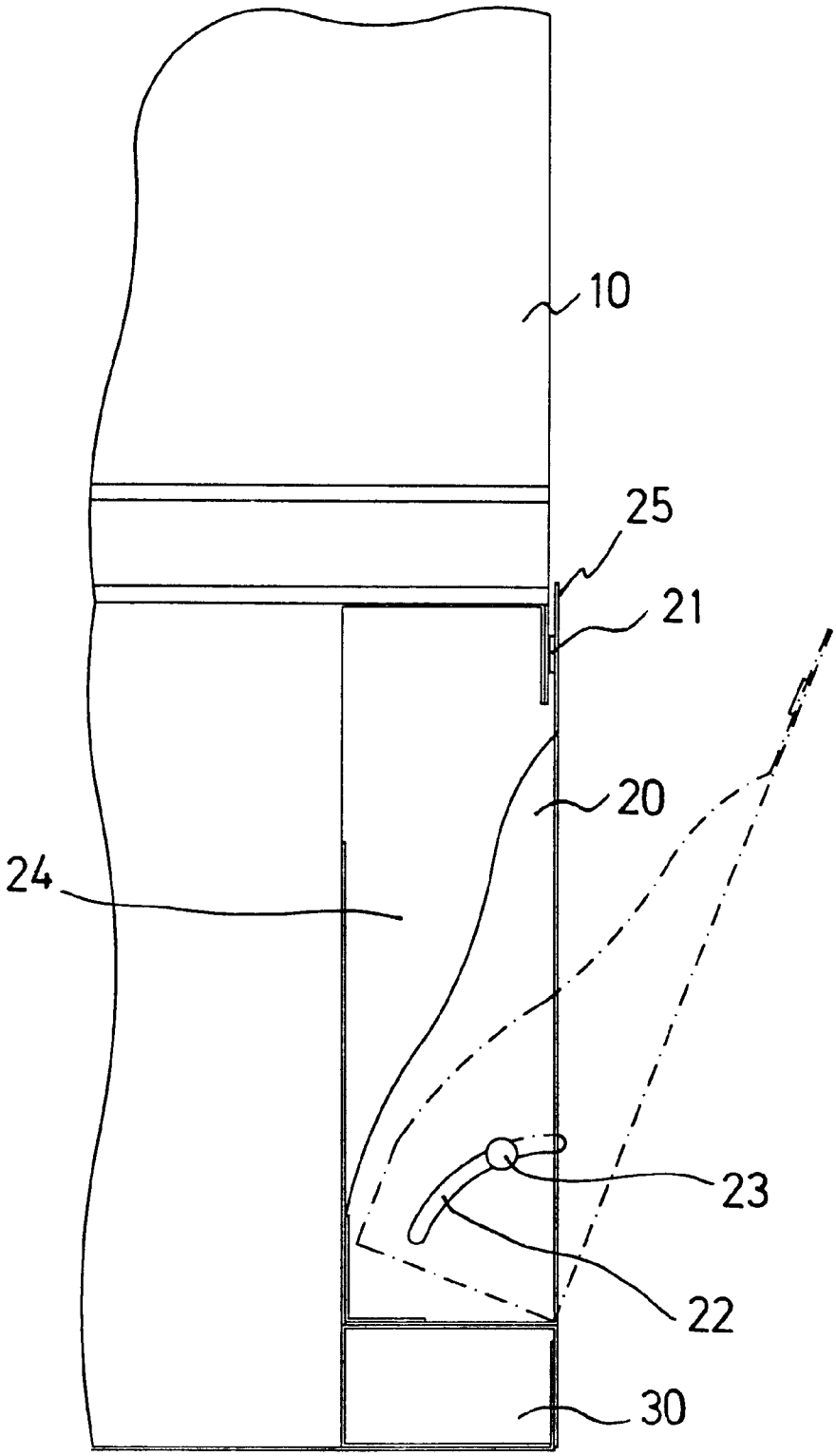
FIG. 3 is a partial front view of the bag.

Referring to the drawings, and initially to FIGS. 1–5, a bag 10 in accordance with the present invention comprises a bag body 10 and comprises a side portion including a fastener 11, such as a male fastener or a snap fastener 11 secured thereon and including a chamber 18 formed therein and including a base 30 provided in the bottom thereof. The bag 10 includes a flange 16 formed in the upper portion of the side portion for supporting the fastener 11.

Figure 5:
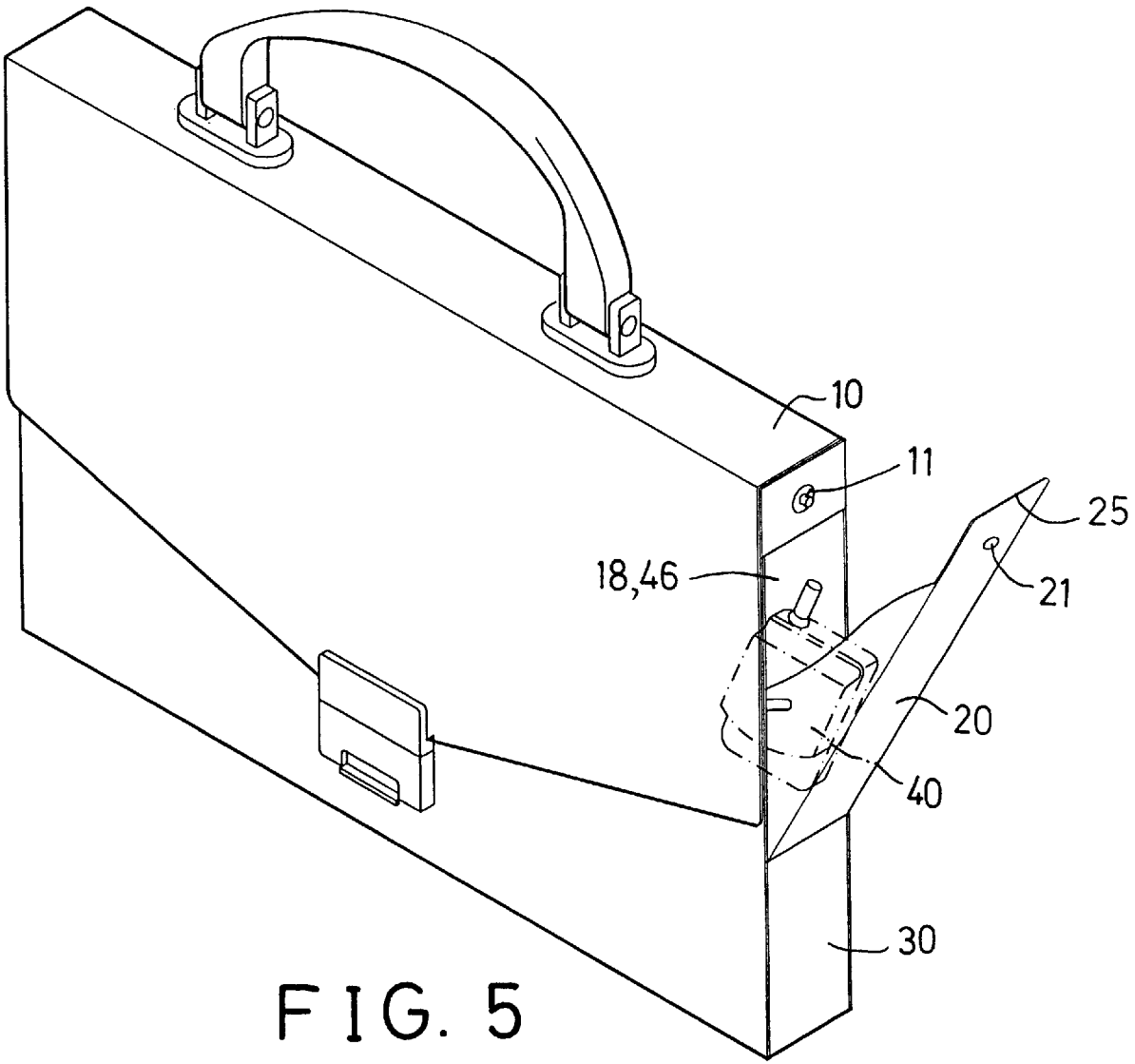
FIGS. 5, 6, 7 are perspective views illustrating the operation of the bag.
Figure 6:
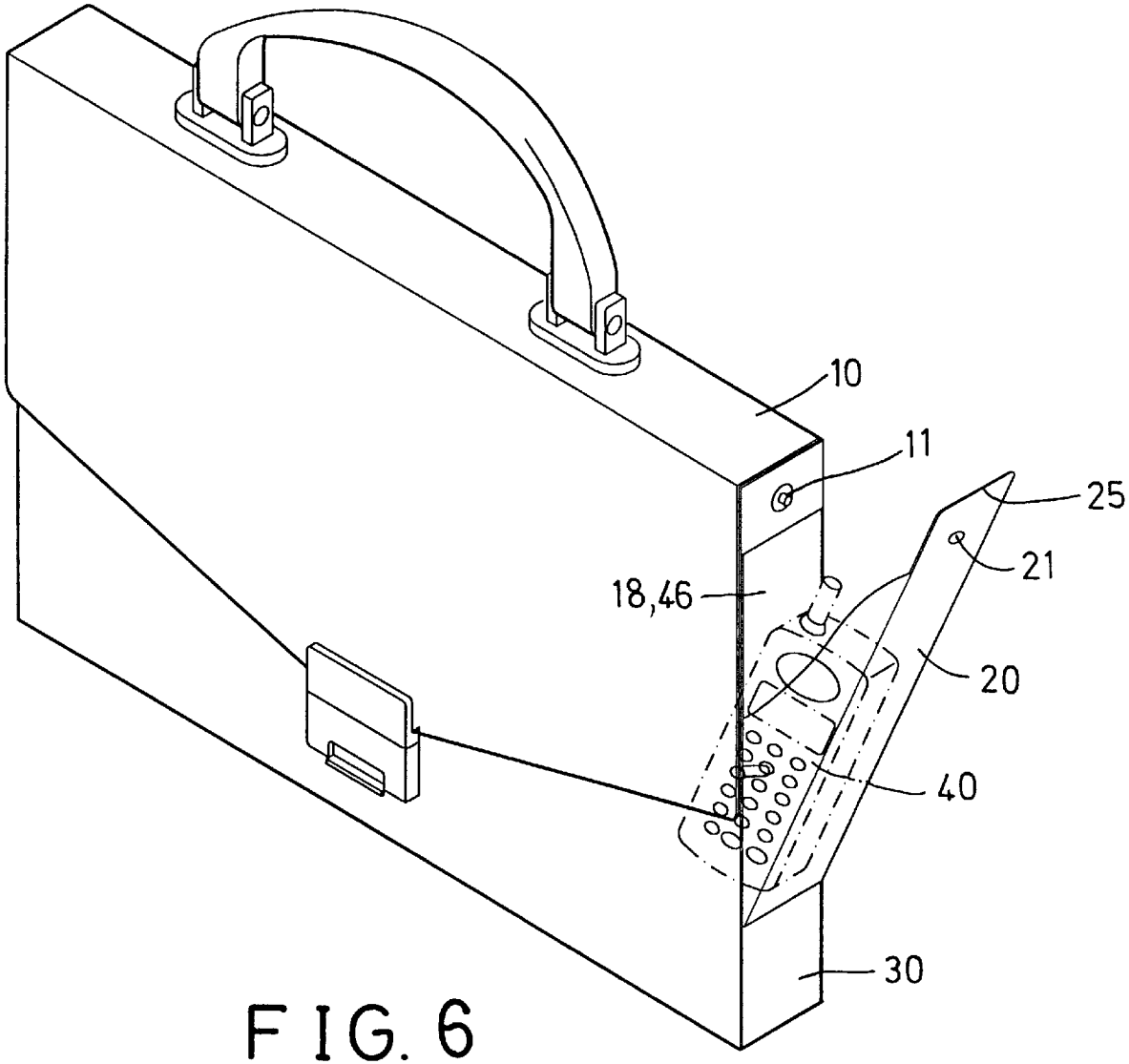
Figure 7:
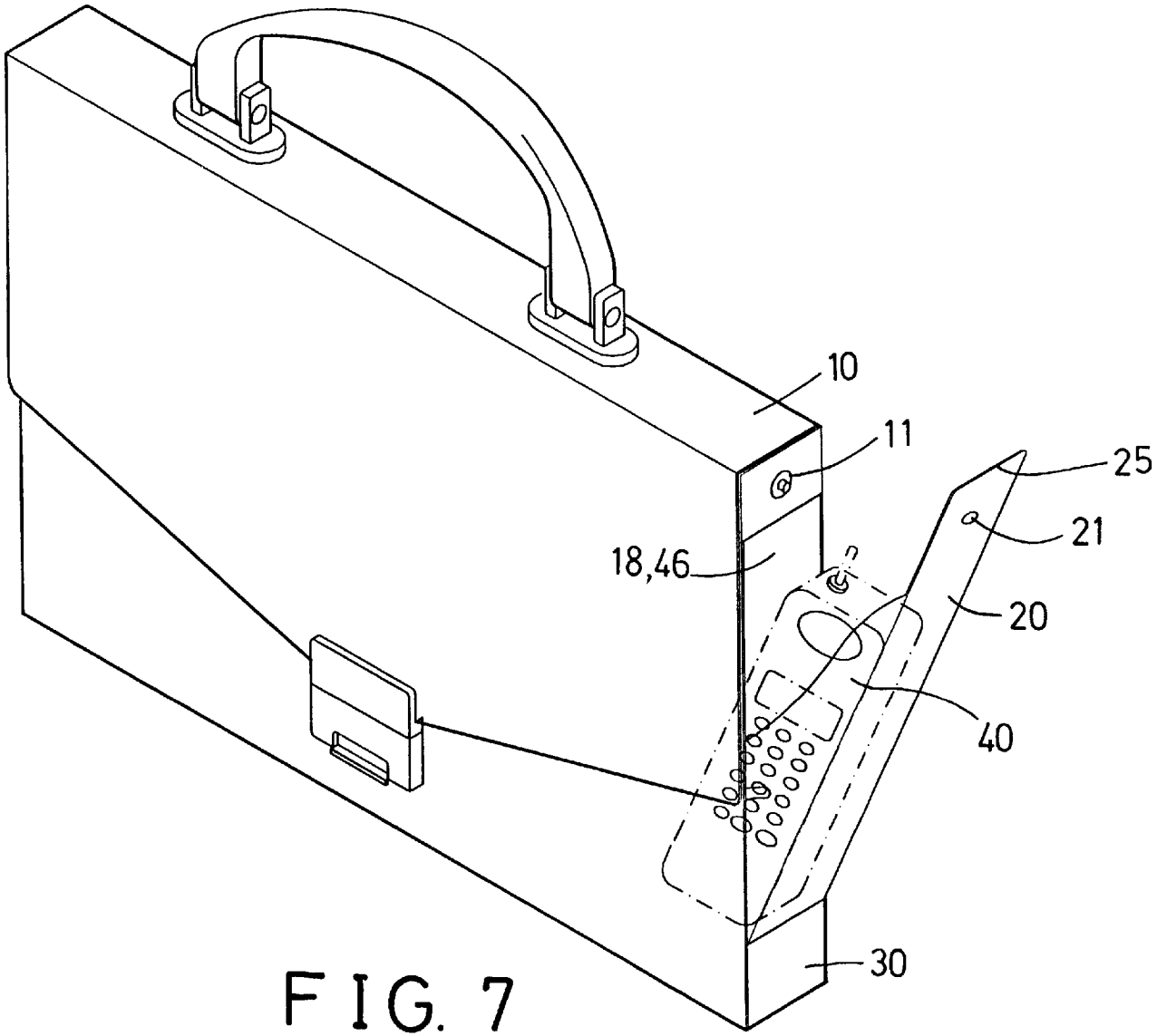

A housing 4 is received in the chamber 18 of the bag 10 and includes a partition 41 secured between the inner portions of two plates 42 that are located in the bag 10 and includes an opening 46 formed in the side portion opposite to the partition 41. A casing 20 has a bottom side portion pivotally coupled to the housing 4 at a hinge line 48 and includes a female fastener or a snap fastener 21 secured to the upper portion for engaging with the fastener 11 and for securing the casing 20 to the housing 4 and to the bag 10, and includes an upper handle 25 for allowing the casing 20 to be easily opened from the bag 10. The casing 20 includes a box 28 provided in the bottom portion for receiving the cellular phone or the portable phone 40 and includes a notch 24 formed in the upper portion for allowing the cellular phone 40 to be easily removed from the casing 20 (FIGS. 5–7). The partition 41 preferably includes an orifice 44 formed in the upper portion for allowing the portable phone 40 to be seen from inside of the bag 10. The box 28 includes two sides each having a curved slot 22 formed therein. Two fasteners 23 are secured to the front and the rear portions of the bag 10 and engaged through the plates 42 of the housing 4 and slidably received in the curved slots 22 of the box 28 for pivotally coupling the lower portion of the casing 20 to the bag 10 and for limiting the outward rotational movement of the casing 20 relative to the bag 10 and the housing 4.

Referring next to FIGS. 5–7, the bases 30 of the bags 10 may be formed with different sizes such that the chamber 18 of the bag 10 and the opening 46 of the housing 4 may also be formed with different sizes for receiving the cellular phones 40 of different sizes. In operation, the cellular phones 40 may be easily engaged into and removed from the casing 20 when the casing 20 is rotated outward from the bag 10 and the housing 4, without opening the bag 10. The housing 4 may further be solidly secured to the bag body 10 with such as an adhesive material or by a welding process.

Figure 8:
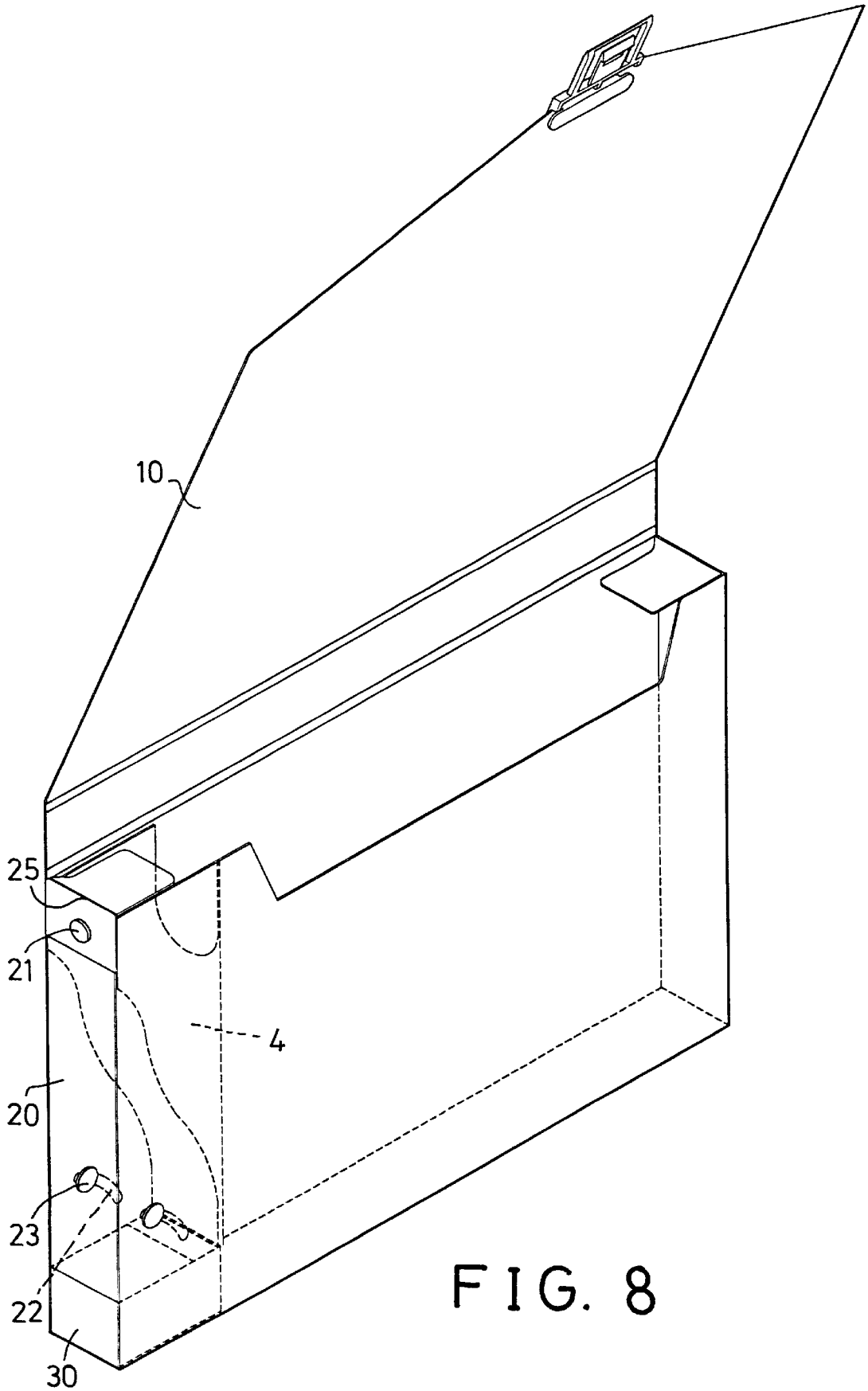
FIG. 8 is a perspective view illustrating the other application of the bag.

Referring next to FIG. 8, the housing 4 and the casing 20 may also be received in the other side of the bag 10.

Accordingly, the bag in accordance with the present invention includes a structure for receiving the cellular phones or the portable phones and for allowing the cellular phones to be easily engaged into and removed from the casing without opening the bag 10.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A bag comprising:

a bag body including a chamber formed therein, said bag body including at least one fastener secured thereto, and a casing pivotally secured to said bag body and receivable in said chamber of said bag body for receiving an object and for allowing the object to be engaged into and removed from said casing when said casing is opened relative to said bag body, said casing including a bottom portion having at least one curved slot formed therein for slidably receiving said at least one fastener of said bag body and for pivotally coupling said bottom portion of said casing to said bag body.

2. The bag according to claim 1, wherein said bag body includes a side portion having said chamber formed therein said casing includes a bottom portion pivotally coupled to said bag body and includes an upper portion, and means for detachably securing said upper portion of said casing to said bag body.

3. The bag according to claim 1 further comprising a housing secured in said chamber of said bag body, said casing including a bottom portion pivotally coupled to said housing at a hinge line and including an upper portion, and means for detachably securing said upper portion of said casing to said bag body.

4. The bag according to claim 3, wherein said housing includes two plates and a partition secured between said plates and located in said bag body, said partition includes an orifice formed therein.

5. The bag according to claim 1, wherein said casing includes a bottom portion having a box provided therein for receiving the object.

* * * * *